US005757876A

United States Patent [19]

Dam et al.

[11] Patent Number: 5,757,876

[45] Date of Patent: May 26, 1998

[54] OBJECT COUNTER AND IDENTIFICATION SYSTEM

[75] Inventors: Naim Dam, Muttontown; William A. Allhusen, Bethpage, both of N.Y.

[73] Assignee: Cosense, Inc., Hauppauge, N.Y.

[21] Appl. No.: 795,143

[22] Filed: Feb. 7, 1997

[51] Int. Cl.[6] ..... G03M 7/00

[52] U.S. Cl. ..... 377/7; 377/14; 377/24

[58] Field of Search ..... 377/6, 7, 13, 14, 377/24

[56] References Cited

U.S. PATENT DOCUMENTS 4,026,309 5/1977 Howard ..... 377/7

4,755,941 7/1988 Bacchi ..... 364/412

*Primary Examiner*—Margaret Rose Wambach

*Attorney, Agent, or Firm*—Gordon D. Coplein

[57] ABSTRACT

A system for counting the number of objects of known thickness in a stack and identifying the objects by their color in which an ultrasonic sensor is mounted at a known distance from a reference point that defines the beginning of the stack. The ultrasonic sensor is operated to measure the round trip transit time of ultrasonic energy reflected back from the closest object in the stack and the number of objects in the stack is calculated on the basis of the known distance and the round trip transit time. A color sensor senses the color of at least one object in the stack to identify the object. In a casino application where the objects are chips of known monetary value, the value of the chips in the stack can be calculated.

9 Claims, 3 Drawing Sheets

OBJECT COUNTER AND IDENTIFICATION SYSTEM

FIELD OF THE INVENTION

The present invention is directed to the field of automatically counting the number of objects in a stack and identifying the objects on the basis of a color characteristic.

BACKGROUND OF THE INVENTION

A need sometimes exists to count a plurality of objects in a stack and to identify the type of each object in the stack on the basis of a certain characteristic, for example, its color. One such need is found in the casino environment where a dealer has a tray with a plurality of columns in each of which columns a number of chips of the same monetary equivalent designation are to be stacked. For example, one type of tray may have a plurality of columns and chip denominations of $1, $5, $10, $25, etc. are stacked in the respective columns. Each denomination of chip has a particular identification characteristic, such as color.

For control and accounting purposes the supervisor of a group of locations, such as a number of card and/or dice tables, visually monitors the tray or trays at each location to determine the conduct of the play, the amount of money being wagered and to try to ascertain if the 'house' is winning or losing. A need exists to provide more accurate information for this purpose. Also, the casino would like to have instantaneous information for all of the tables as to how play is progressing, the amount of money being wagered, the efficiency of a particular dealer and for other reasons. Therefore, it becomes desirable to be able to count the number of chips in each tray on an automatic basis.

U.S. Pat. No. 4,755,941 to Lorenzo Becchi discloses a type of casino play monitoring and accounting system in which trays at the table are monitored as well as using a keypad or keyboard to enter cash transactions of a customer purchasing chips. This system uses a tray having a plurality of LEDs along each column. Each LED is to detect the presence or absence of an individual chip in its tray column. Such a tray monitoring system has problems in that it is difficult to construct with the plurality of LEDs and the LEDs produce 'cross-talk' in the data acquisition mode which can effect the accuracy of the system. Also, the tray monitoring approach used by this patent cannot identify the individual chips by any characteristic, such as color.

BRIEF DESCRIPTION OF THE INVENTION

The present invention relates to a system that can be used to count the number of objects in a stack, such as in each of the columns of a casino tray for chips, and also to identify the individual objects, such as chips, by their respective colors. In accordance with the invention each column of the tray has a narrow beam ultrasonic sensor. The overall distance of a tray column is known and the sensor measures the distance between it and the closest object (chip) in the stack. Since the thickness of the object is known, by subtracting the distance measured by the sensor from the overall column distance, the number of objects in the stack of a column can be computed.

Each column of the tray is also provided with a sensor that can identify individual objects on the basis of one or color characteristics of the object. In one embodiment of the invention the ultrasonic sensor and color sensor are at one end of each tray channel and preferably integrated into a single package. This permits the identity of the object closest to the color sensor placed in a column to be determined on the basis of its color or individual objects to be so identified as they are placed in a column one at a time.

In another embodiment, the color of the object for each column can be preset and if a dealer places the wrong color object in the column an alarm can be actuated. In still a further embodiment, a color sensor at one end of a tray column can be used to set the reference color of the column by the first object placed in the column and a color sensor at the other end used to sense each additional object placed in the column. A mis-match of the two colors actuates an alarm if the wrong type of object, as determined by its color, is being placed in the column.

OBJECT OF THE INVENTION one object of the invention is to provide a system for counting the number of objects in a stack of objects and to identify such objects on the basis of a physical characteristic, such as color.

A further object of the invention is to provide a tray for stacking objects, such as chips for a casino, having sensors to determine both the number of chips in a tray column and the identity of the chips by their color.

Another object is to provide a tray for casino chips that uses an ultrasonic sensor to detect the number of chips in a tray column by measuring round trip transit time of ultrasonic energy reflected from a chip in the tray column and a color sensor for detecting the identity of the type of chip in the column.

Still a further object is to provide a system for measuring the value of a plurality of casino chips in a column of a tray by measuring the round trip time of a pulse of transmitted ultrasonic energy reflected from the chips, determining the value of the chips on the basis of a color characteristic and calculating the value from this information.

BRIEF DESCRIPTION OF THE DRAWINGS

Other objects and advantages of the present invention will become more apparent upon reference to the following specification and annexed drawings in which.

DETAILED OF THE INVENTION

Figure 1:
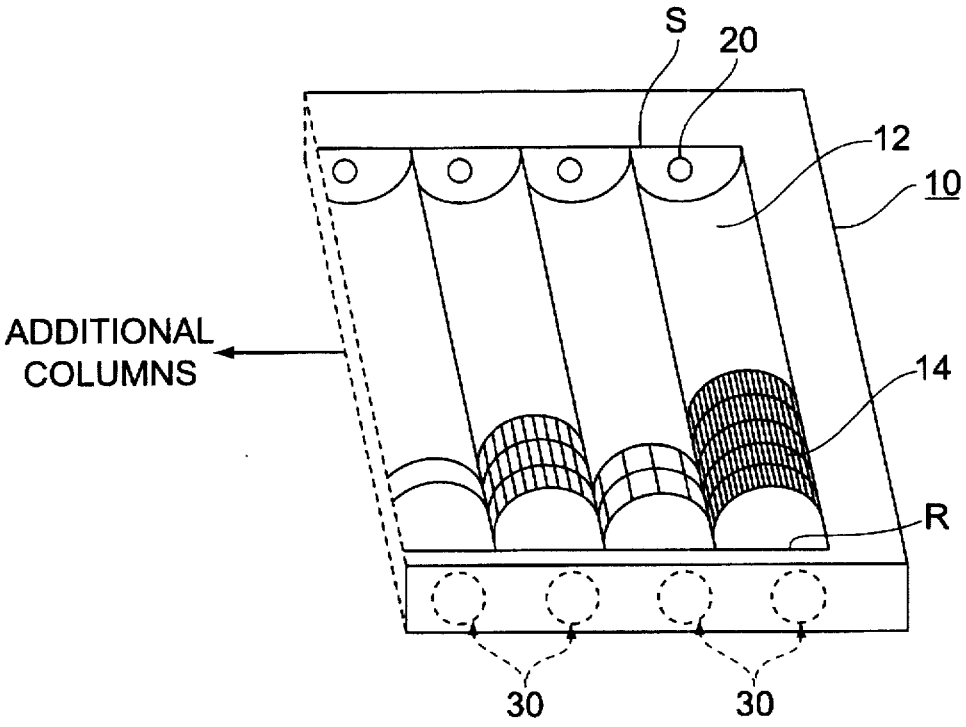
FIG. 1 is a perspective view of a typical tray.

A preferred embodiment of the invention is described with respect to a chip holding tray for use in a casino. Referring to FIG. 1, a tray 10 is shown having a plurality of columns 12, here illustratively shown as four, although a greater of lesser number can be used. Each column 12 is used to stack a plurality of objects, such as casino chips 14. Each of the chips is identified by a particular characteristic, such as a color. This is shown by the different types of cross-hatching for the chips of the different columns. Each color chip has a predetermined monetary value.

In use, a tray 10 is usually mounted at a slight angle to the horizontal so that the chips 14 will accumulate in each column 12 against one end wall 18, hereafter called a reference end R. At the opposite end wall, hereafter called the sensing end S, there is an ultrasonic sensor 20, to be described in detail below, in each of the columns 12. The physical length of each column 12 is known as is the thickness of each chip 14. The chip thickness is the same for all monetary values.

Upon transmitting an ultrasonic signal from a transducer along the length of its respective column, it is reflected back to the transducer from the closest chip in the column. By measuring the round trip time of the ultrasonic signal, the number of chips in a respective column can be determined. This is a simple calculation to be performed by a microprocessor in terms of subtracting the round trip time of the reflected signal from the known round trip time of transmission of a signal corresponding to the full length of a column. The distance result is divided by the known thickness of a chip and this gives a count of the number of chips in a column.

In a preferred embodiment of the invention, as described below, the sensors 20 of the plurality of tray channels are energized simultaneously so that the count of all of the tray columns can be acquired at the same time and the monetary value for each channel calculated as desired, either simultaneously or in sequence.

In addition to the chip count in each tray column 12 it is desired to calculate their monetary value. That is, the chip count is to be multiplied by the value of the chips in the column, for example, as determined by their color. A computer can process this data for use by the casino.

In general, each dealer who is responsible for a tray, or trays, at a gaming table sorts the different value chips to his own liking. The dealer is usually only required to keep chips of only one value (color) in each tray column. In accordance with the invention, the tray 10 also has a color sensor 30, to be described below, in each column. By identifying the color of the chips in each of the columns, the monetary value of the chips can be calculated since chips of a particular color have a predetermined monetary value. Here also, the operation of the color sensors 30 can be multiplexed. It is preferred that each column 12 of a tray be checked in sequence with both the count sensor 20 and the color sensor 30 operation for one channel being completed before the next column is checked.

Figure 2:
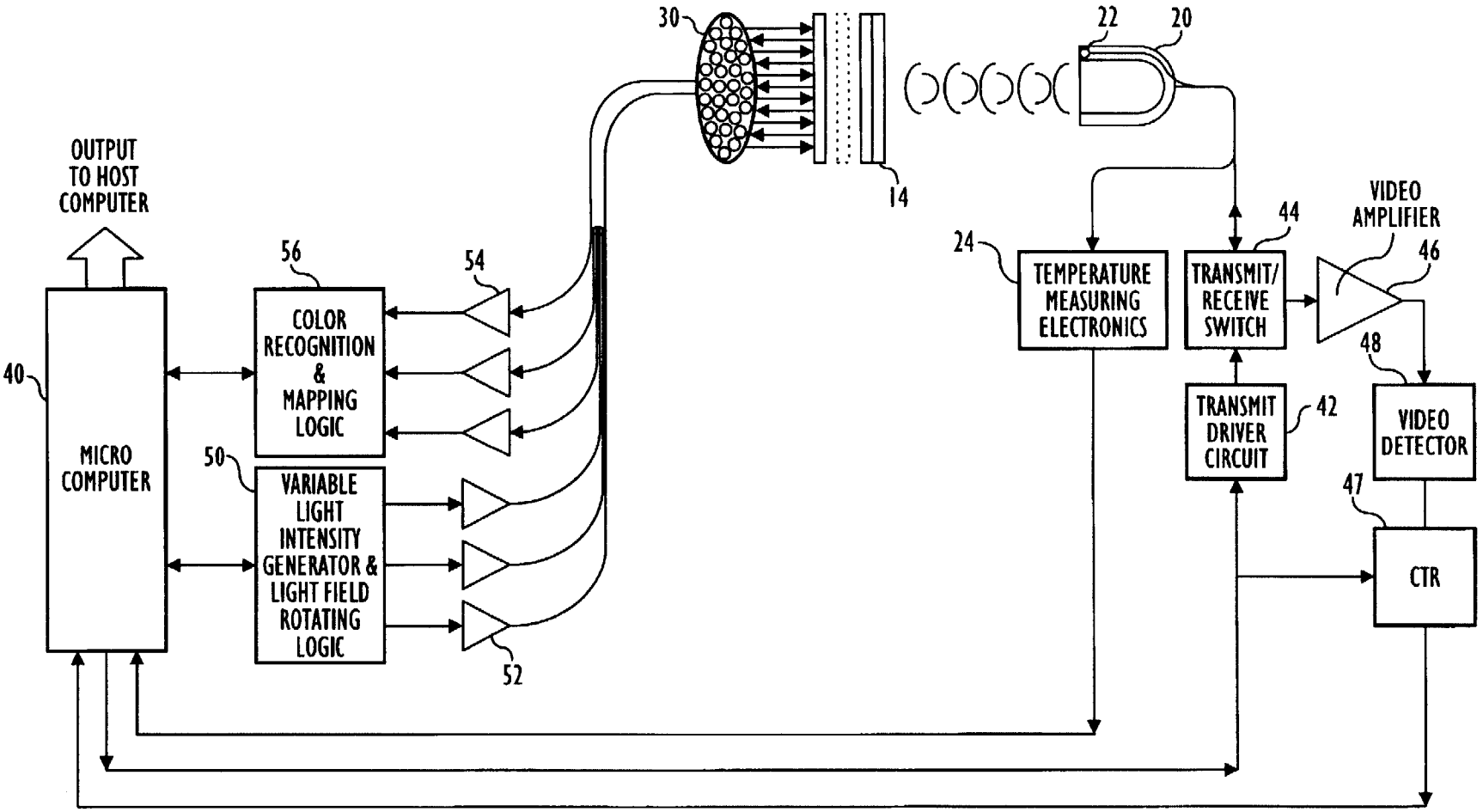
FIG. 2 is a schematic block diagram of the system.

FIG. 2 is a schematic block diagram of the system showing details of the ultrasonic sensor 20 and color sensor 30 for a single tray column. A microprocessor 40 of a suitable capacity that has been appropriately programmed controls the operation of the system. The microprocessor 40 generates an appropriate signal at the start of a cycle for measuring the column to actuate a transmit driver circuit 42 for the ultrasonic sensor 20. This produces a signal of the appropriate frequency, to be described below, that is applied through a transmit-receive switch 44 to the transducer (not shown), for example of the PZT piezoelectric type, of the ultrasonic sensor 20. The trigger signal from the microprocessor also triggers a counter 47 to start counting. Counter 47 can be, for example, a sixteen bit counter with a clock frequency of 50 Mhz.

After the signal is transmitted by the sensor 20, the switch 44 changes to the receive mode under control of the microprocessor 40. The signal reflected back from the closest chip in the column, or from the column opposing wall R if the column is empty of chips, is applied to a video amplifier 46 and then to a video detector 48. The output of the video detector is applied to the counter 47 to stop the count. The accumulated count corresponds to the round trip time of the ultrasonic signal. That is, it is the measurement of the distance. The output count of counter 47 is applied to microprocessor 40. The sensor 20 also preferably has a temperature sensor 22 that is applied to a temperature measuring circuit 24 and the temperature data, which is in digital form, is also supplied to the microprocessor 40. The microprocessor 40 computes the round trip transit time of the signal transmitted from sensor 20 from the count of counter 47, as modified by the temperature sensed, and from this calculates the number of chips in the column.

In a preferred embodiment of the invention the ultrasonic sensors 20 for all of the columns 12 of a tray 10 are operated at the same time. That is, each sensor 20 has its own switch 44, video amplifier 46, video detector 48 and counter 47. The microprocessor 40 triggers the start of the measuring cycle for all of the sensors 20 of the tray at the same time. The data obtained from each sensor 20 during the measurement cycle is stored in its respective counter 47 and each of the counters is connected to the microprocessor 40 data input line. At a predetermined time the microprocessor 40 looks at the data of each counter 47 and processes it to produce output data. The counter 47 of the column is set to count to its maximum limit if no chips are present in a column of the tray. This avoids an overflow condition.

Microprocessor 40 also controls a light generator and light field rotating logic circuit 50. As described in greater detail below, this provides the necessary signals that are transmitted through a set of amplifiers 52 to the color sensor 30 to enable it to sense the color of the chip. The color sensor 30 has detectors and the information sensed is applied through a set of amplifiers 54 to a color recognition and logic circuit 56 that identifies the sensed color of the chips in a channel and, consequently, their respective monetary values. This information also is applied to the microprocessor 40. Using the information returned from the two sensors 20 and 30, the microprocessor 40, or another computer, can make a numerical value calculation of the value of the chips in a column.

The color sensors 30 in the tray preferably are gated on sequentially to scan each tray column. This is done to economize on the color sensor electronics. Scanning is accomplished by providing a multiplexer (not shown). Of course, if desired, the color sensor electronics can be replicated and the color sensor data for each channel produced continuously. In this case the microprocessor 40 would scan the color sensing electronics for each channel to acquire the data and associate it with the chip count data for the channel.

Figure 3B:
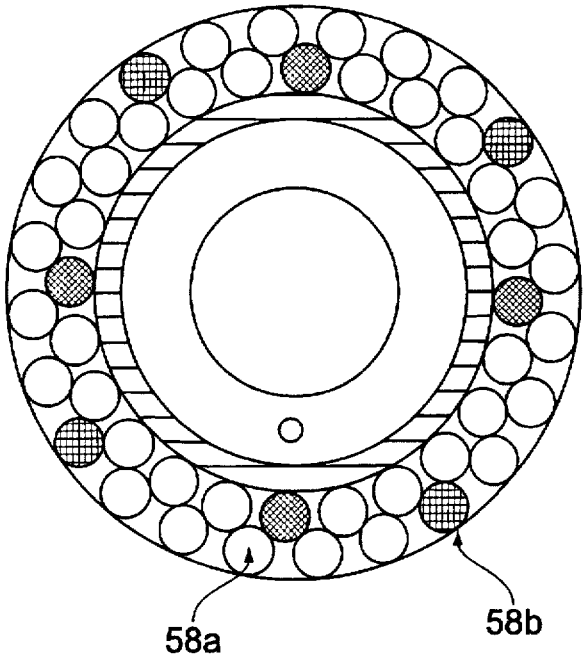
FIGS. 3A and 3B are side and front views respectively of a unit containing both an ultrasonic and a color sensor.
Figure 3A:
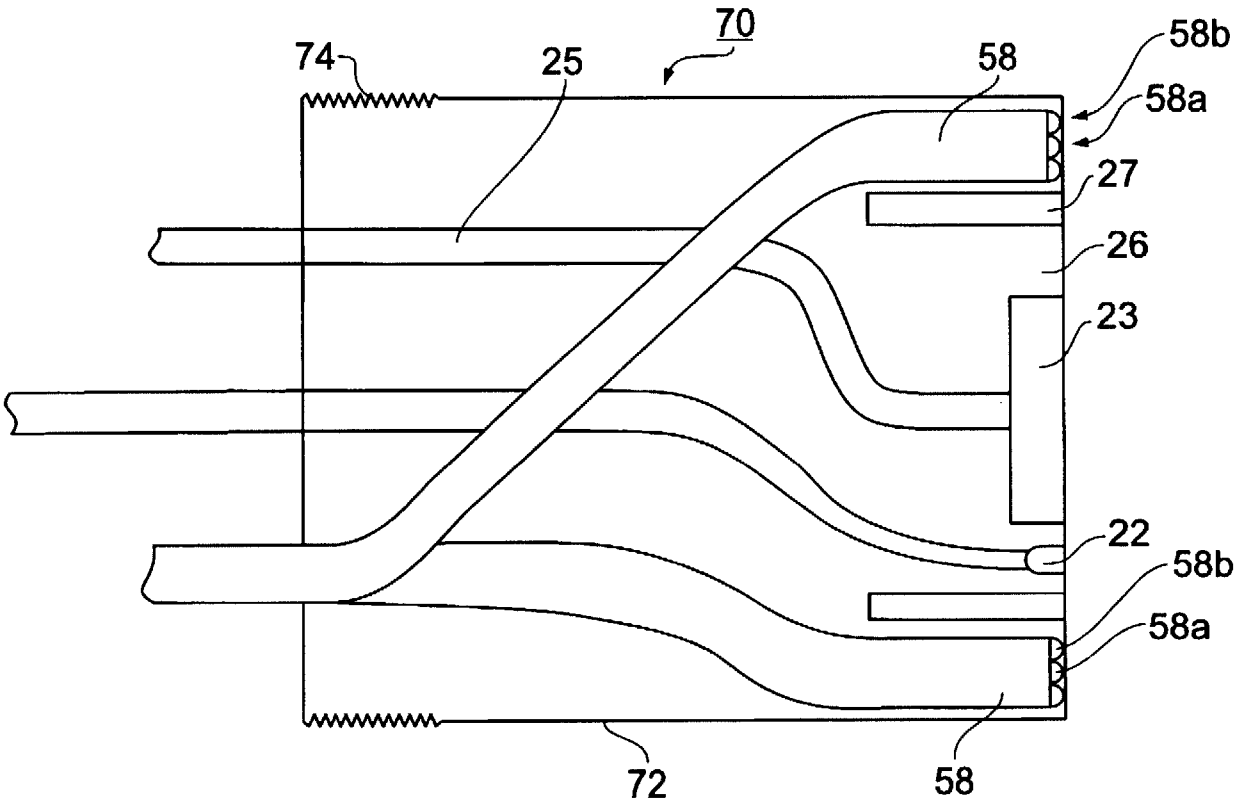

FIGS. 3A and 3B show a combined ultrasonic and color sensing detector 70. It should be understood that the combined sensor of these figures can be split into two parts. That is, the ultrasonic and color sensing portions each can be in separate housings, as shown in FIG. 1, and used at the same end wall of the tray. Sensor 70 has a housing 72 with a threaded end 74. At the other end of the housing is a piezoelectric element 23, such as of PZT, mounted to a front window 26 of the housing. The part of the front window 26 for the ultrasonic sensor can be, for example, of stainless steel or of MYLAR plastic. An impedance matching element (not shown) which can be, for example, of rubber, is used to match the impedance of the element 23 to the window 26 and to the air interface in front of the window. This reduces unwanted ringing. A cable 25 connects element 23 to the electronic circuit shown in FIG. 2. The temperature sensor 22 also is mounted to the front window 26 and preferably extends through the window to more accurately sense the temperature.

The ultrasonic sensor element 23 receives energy from the driver circuit 42 preferably at a frequency of at least about 250 KHz. This frequency provides a distance measuring resolution of about 0.02", which is about one-sixth the thickness of a standard casino chip. Making the frequency higher will increase the measuring resolution. A frequency of 500 KHz has been found to be satisfactory. Increasing the frequency to the range of 1 Mhz–2 Mhz will increase the measurement precision. Also, it is preferred that the angle of the energy beam from sensor 20 be made as narrow as possible. This minimizes crosstalk between adjacent columns.

The color sensor has a plurality of bundles 58 of optical fibers are located around the outer periphery of the housing 72. There can be a transparent front window for the bundles. The color sensor uses the bundles 58 in a manner to be color specific. That is, each bundle 58 has one or more optical fibers 58*a* that transmits white light and one or more fibers 58*b* used as color specific detectors. When used as a detector a fiber has a filter to pass light of a specific color corresponding to the color of one of the chips that is to be held in the tray.

Since sensor 70 has a plurality of the fiber bundles 58, each one can be specific to a particular chip color. For example, if five different color chips are to be held by a tray, then each of the bundles 58 would have five different color detectors. Alternatively, each of the bundles can be color specific. There can be several bundles for each specific color which would preferably be spaced at different locations around the housing periphery. Also, there can be bundles which transmit only white light and bundles that have only color detectors.

Operation of the color sensor portion of the combined sensor 70 is also controlled by the microprocessor 40. In a typical operation cycle of the color sensor of a tray column, the white light is pulsed or is continuously on. The light is reflected back from the chip 14 in the tray column 12 to the color detectors in the sensor fiber optic bundles. The amplitude of the output from the different color detectors will vary depending upon the color of the chip from which the light is reflected. This information is used by the color mapping circuit 56 to determine the color. All of the bundles 58 of a sensor 30 are operated at the same time or the bundles can be scanned sequentially, such as proceeding around the ring of bundles one at a time. As another alternative, the fiber detectors for each specific color can be scanned sequentially. Each of these alternatives can be programmed for operation by the microprocessor 40.

In a further alternative, the color sensor for one column can be set to a specific color. An alarm is sounded if a chip of a different color is placed in the column. This type of operation also can be programmed into the microprocessor 40.

Preferably, one tray column 12 at time is scanned for color information. The color recognition and mapping logic circuit 56 detects the color that corresponds to the light reflected from the chip in the column. This can be either the maximum or minimum amplitude signal from a particular color detector depending upon whether an additive or subtractive system is being used.

During the scanning of a tray column 12 for chip color information, the ultrasonic sensor 20 is also operated to acquire the information relative to the chip count. Information of the chip count of a column and the value of the chips in the column on the basis of the color is collected in the microprocessor 40 and thereafter it is conveyed to a central computer (not shown) which accumulates data from one or more of the trays of the tables of the casino and performs the necessary accounting functions.

While the invention has been described with respect to the particular application for counting chips in a tray, it has other applications. For example, in a warehouse application where objects such as containers of different colors are stacked, the system can be used to count and identify the model number of the objects by their color.

We claim:

1. A system for counting the number of objects of known thickness in a stack and identifying the objects by their color comprising:

an ultrasonic sensor mounted at a known distance from a reference point that defines the beginning of the stack;

means operating said ultrasonic transducer and to measure the round trip transit time of ultrasonic energy reflected back to said transducer from the object in the stack closest to said ultrasonic sensor to thereby calculate the number of objects in the stack; and a color sensor to sense the color of at least one object in the stack.

2. A system as in claim 1 further comprising a tray having at least one channel for holding a stack of objects, and a said ultrasonic sensor and color sensor mounted in said at least one channel.

3. A system as in claim 2 wherein said ultrasonic sensor is at one end of said at least one tray channel and a color sensor is at the other end of said at least one channel.

4. A system as in claim 1 wherein said ultrasonic sensor and said color sensor are mounted in a single housing.

5. A system as in claim 2 wherein said ultrasonic sensor and said color sensor are mounted in a single housing and said housing is provided for said at least one tray channel.

6. A system as in claim 1 further comprising means responsive to the color detected by the color sensor for determining if the color of an object placed in the stack matches a predetermined color.

7. A system as in claim 2 further comprising means responsive to the color detected by the color sensor of a channel for determining if the color of an object placed in the stack matches a predetermined color.

8. A system as in claim 2 wherein said tray has a plurality of channels with said ultrasonic and color sensor in each said channel and further comprising means for sequentially scanning the color sensors of the channels of a tray.

9. A system as in claim 2 wherein said tray has a plurality of channels with said ultrasonic and color sensor in each said channel and further comprising means for operating the ultrasonic sensors of all of the channels at the same time.

* * * * *